US005437446A

United States Patent [19]

Youngkin

[11] Patent Number: 5,437,446

[45] Date of Patent: Aug. 1, 1995

[54] METHOD FOR ALIGNING A GOLF PUTTING STROKE

[76] Inventor: Carroll Youngkin, 11831 Wexwood Dr., Richmond, Va. 23236

[21] Appl. No.: 288,099

[22] Filed: Aug. 9, 1994

[51] Int. Cl.[6] ..... A63B 57/00

[52] U.S. Cl. ..... 273/32 A; 273/213; 273/32 H

[58] Field of Search ..... 273/32 A, 213, 32 H, 273/187.6

[56] References Cited

U.S. PATENT DOCUMENTS

| | | | |
|---|---|---|---|
| D. 198,037 | 4/1964 | Thayer | D34/5 |
| D. 203,604 | 2/1966 | Lo Jacono | D34/5 |
| D. 319,862 | 9/1991 | Lahger | D21/234 |
| D. 324,555 | 3/1992 | Evans | D21/219 |
| D. 333,331 | 2/1993 | Evans | D21/214 |
| 676,506 | 6/1901 | Knight et al. | 273/213 |
| 1,735,736 | 11/1929 | Davidson | 273/32 A |
| 2,107,944 | 2/1938 | Howard | 273/32 |
| 3,041,071 | 6/1962 | Fialon | 273/32 |
| 3,415,518 | 12/1968 | Root | 273/32 |
| 3,866,749 | 2/1975 | Stainer | 206/234 |
| 3,938,805 | 2/1976 | Sakuma | 273/32 |
| 4,007,928 | 2/1977 | Doubt | 273/32 A X |
| 4,521,018 | 6/1985 | Cotchonis | 273/32 |
| 5,110,123 | 5/1992 | Larson | 273/32 |
| 5,125,664 | 6/1992 | Evans | 273/183.0 |
| 5,282,622 | 2/1994 | Evans | 273/164.1 |
| 5,356,133 | 10/1994 | Bellagamba | 273/32 A |

*Primary Examiner*—George J. Marlo
*Attorney, Agent, or Firm*—Millen, White, Zelano, & Branigan

[57] ABSTRACT

The alignment of a putting stroke comprises the alignment of direction-indicating markings on a ball position marker with a chosen line of putt to a desired hole; the placement of a golf ball adjacent to the ball position marker so that a line of indicia on the golf ball has the same alignment as the direction-indicating markings; and, the alignment of a desired putter face with the line of indicia so that the putter face is perpendicular to the chosen putt line.

6 Claims, 7 Drawing Sheets

METHOD FOR ALIGNING A GOLF PUTTING STROKE

BACKGROUND OF THE INVENTION

The present invention relates to a method and apparatus for aligning a golf putting stroke.

During the game of golf, a player must often lift his or her ball from the putting green to clean the ball, to avoid obstructing the line of vision for another player's ball, or to avoid interfering with the line of direction of another player's putt. As defined in the 1994 *USGA Rules of Golf*, "Before a ball on the putting green is lifted, its position shall be marked by placing a small coin or some similar object immediately behind the ball; . . . " [*The Rules of Golf* as approved by the United States Golf Association and the Royal and Ancient golf Club of St. Andrews, Scotland. (1994)]

A variety of golf ball markers have been designed which have pointers or indicia on their surface to indicate which side of the marker toward which the ball is to be replaced. Such markers are shown, for example, in U.S. Pat. Nos. D.D. 198,037, and 203,604.

The indicia found on the surfaces of ball markers are varied. U.S. Pat. No. 3,938,305 to Kei Sauma, shows an arrow-shaped portion of a ball marker. Fialon, U.S. Pat. No. 3,041,071, depicts a line on top of a ball marker; U.S. Pat. Nos. 3,866,749 and 1,735,736, illustrate ball markers having pointer elements; and, U.S. Pat. No. 2,107,944 to Howard, indicates that a directional-indicating, or point-marking portion of a marker is adapted for placement nearest to, and preferably, in actual contact with a ball, the position of which is to be marked. These patents, however, do not indicate the use of marker indicia as a means to align the direction of a putting stroke. They merely indicate the specific location of the ball before it was removed from the putting green.

Putter alignment devices are also well known. U.S. Pat. No. 5,282,622 to Evans, and the patents referenced therein, for example, describe guides on a putter to allow a golfer to observe the alignment of the club face or a hole, with respect to a golf ball. These devices, however, cannot properly be used to mark the position of a ball; are not related to lettering or indicia on the ball; and, cannot be left on the green while others are putting. It is an object of the instant invention, therefore, to provide a method of aligning a golf putting stroke that includes a ball-marking apparatus whereby the marker can acceptably and unobtrusively be used both to locate the ball and to provide an initial direction of the putting stroke. The golfer can then concentrate, during the stroke itself, primarily on the distance the ball is to travel and only incidentally on the direction.

SUMMARY OF THE INVENTION

A putting-stroke aligner having stroke-direction marks is used to mark the position of a golf ball on the green by placing the putting-stroke aligner directly behind the ball with the center line of the aligner pointing directly at the center of the hole (see FIG. 3). The ball can then be lifted from the putting green. Stroke-direction marks on the putting-stroke aligner closest to the point where the ball will be replaced are then rotated to be aligned with a chosen line of putt (see FIG. 4). The golf ball is then replaced in line with the hole in front of the putting-stroke aligner in the same spot on the green as before the ball was lifted (see FIG. 5). In this respect, the aligner lines will be pointing at the direction of the putt and may not be pointing at the center of the hole if there is a slope in the surface of the green that affects the putt. The golf ball lettering, or other indicia, is then aligned with the stroke-direction marks on the aligner (see FIG. 6). The aligner is then removed.

In this manner, during the stroke per se, a golfer need only consider the distance of the putt, and strike the golf ball perpendicular to the lettering or indicia on the ball surface (see FIG. 7). The golfer is thereby relieved of the need to consider other details such as the cross-grain of the grass, or the anticipated "break" of the ball because those matters were already considered during the aligning step.

BRIEF DESCRIPTION OF THE DRAWINGS

The foregoing, and other objects, features, and advantages of this invention will be apparent from the more particular description of the preferred embodiments thereof, as illustrated in the accompanying drawings. The drawings are not necessarily intended to be to scale, but rather are presented to illustrate principles of the invention in a clear form.

The entire disclosure of all applications, patents and publications, cited above and below is hereby incorporated by reference.

DETAILED DESCRIPTION OF THE INVENTION

Two factors a golfer must consider while putting are the alignment of the path the ball will travel to reach the hole, and the distance the ball will need to travel to reach the hole.

Figure 1A:
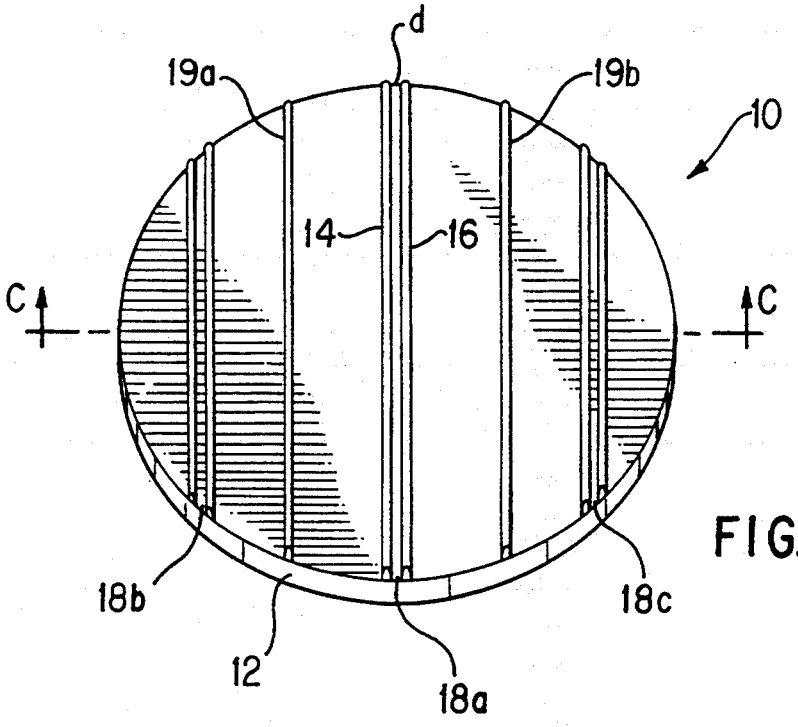
FIG. 1A is a perspective view of the top surface of a putting-stroke aligner.

The present invention provides a method of permitting the golfer to concentrate primarily on the distance factor during the putting stroke, while nevertheless having a putting stroke that is properly aligned. In this respect, FIG. 1A illustrates a thin circular marker 10 having a small thickness 12, a diameter d and a pair of slightly raised lines or ribs 14 and 16, located on either side of the diameter d to form a line 18*a* along the diameter d. The aligner 10 is preferably a flat, annular disk of a heavy material such as metal, and lines such as 14, 16 are preferably raised ribs to form the aligning grooves 18*a*. Other aligning grooves (18*b*, 18*c*) or ribs (19*a*, 19*b*) may appear on the surface parallel to the center, aligner groove (see FIG. 1A).

The aligner 10, can also be comprised of materials such as, but not limited to, ceramic or plastic, and the aligning elements 18 can also be recessed grooves, or comprised of dots, bumps, notches, or arrows, pointers, or any other indicia such as paint or the like that can be used to indicate the desired putting stroke direction. The putting-stroke aligner should be of a design that permits rotation on a center axis without moving the marker and permits replacement of the ball at the exact spot on the green as before the ball was lifted. If desired, the aligner can include a stud 21 depending from the bottom of the marker as shown in FIG. 1D.

Figure 1B:
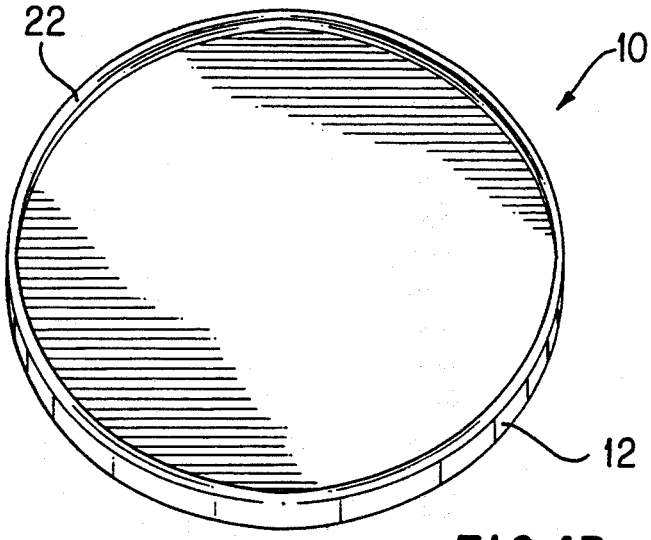
FIG. 1B is a perspective view of the back surface of a putting-stroke aligner emphasizing the rim design.
Figure 1C:
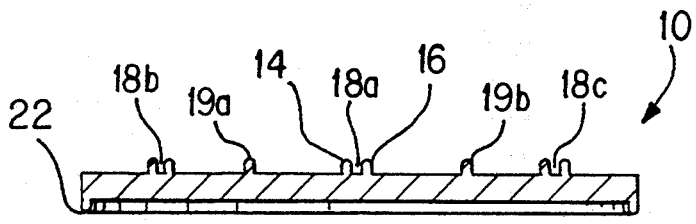
FIG. 1C is a sectional view taken along the lines C—C of FIG. 1A.
Figure 1D:
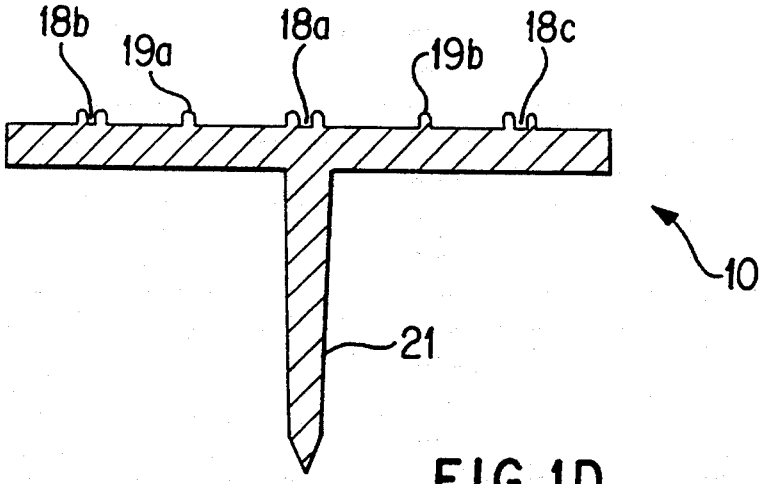
FIG. 1D is a sectional view corresponding to that of FIG. 1C, but including an alternative, depending stud.

Alternatively, the back surface of the putting-stroke aligner can have a narrow collar or rim such as rim 22 around the edge to assist the player in rotating the aligner without otherwise moving the aligner (FIGS. 1A, 1B, and 1C.)

Figure 2:
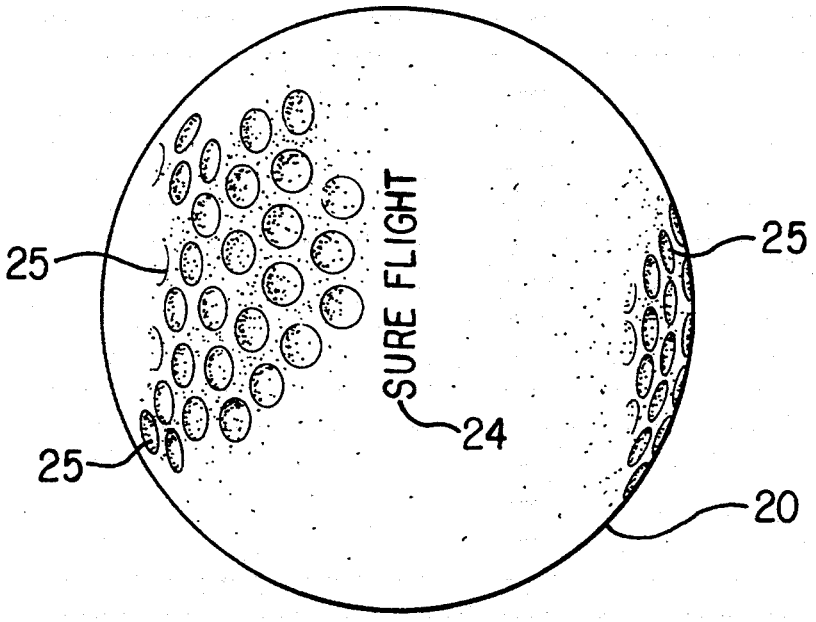
FIG. 2 is a perspective view of a golf ball having aligning indicia thereon.

FIG. 2 illustrates a conventional spherical golf ball 20, which typically has the manufacture's name or brand and/or the golfer's name printed thereon in a line such as 24 in FIG. 2; and, it is this latter aspect of the golf ball which co-acts with the marker of FIG. 1 during the practice of the invention. The line of indicia formed by the line 24 is separately discernible from dimples 25 on the ball 20.

Figure 3:
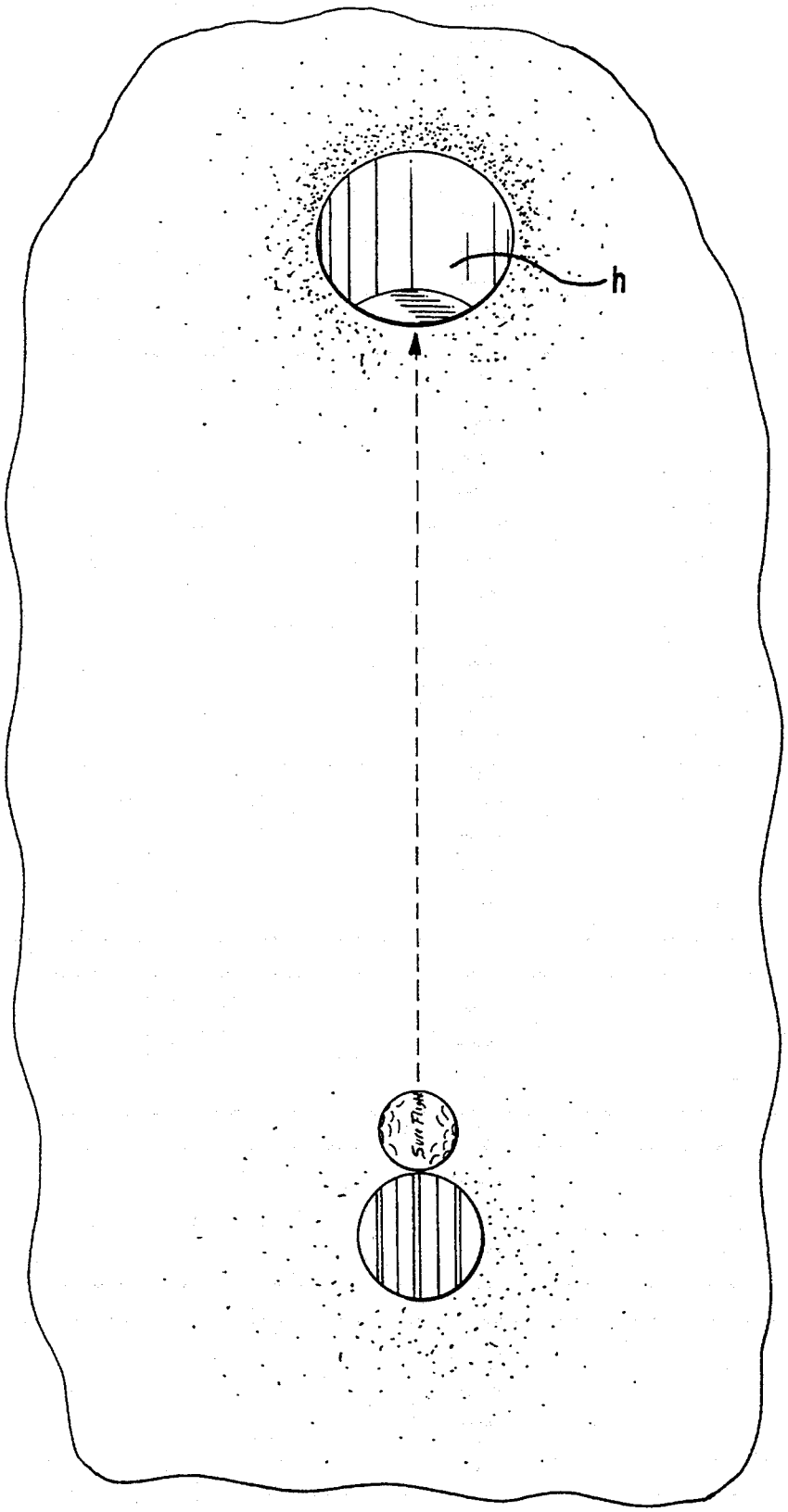
FIG. 3 is a perspective view of the putting-stroke aligner placed behind the ball in line with the center of the hole.
Figure 4:
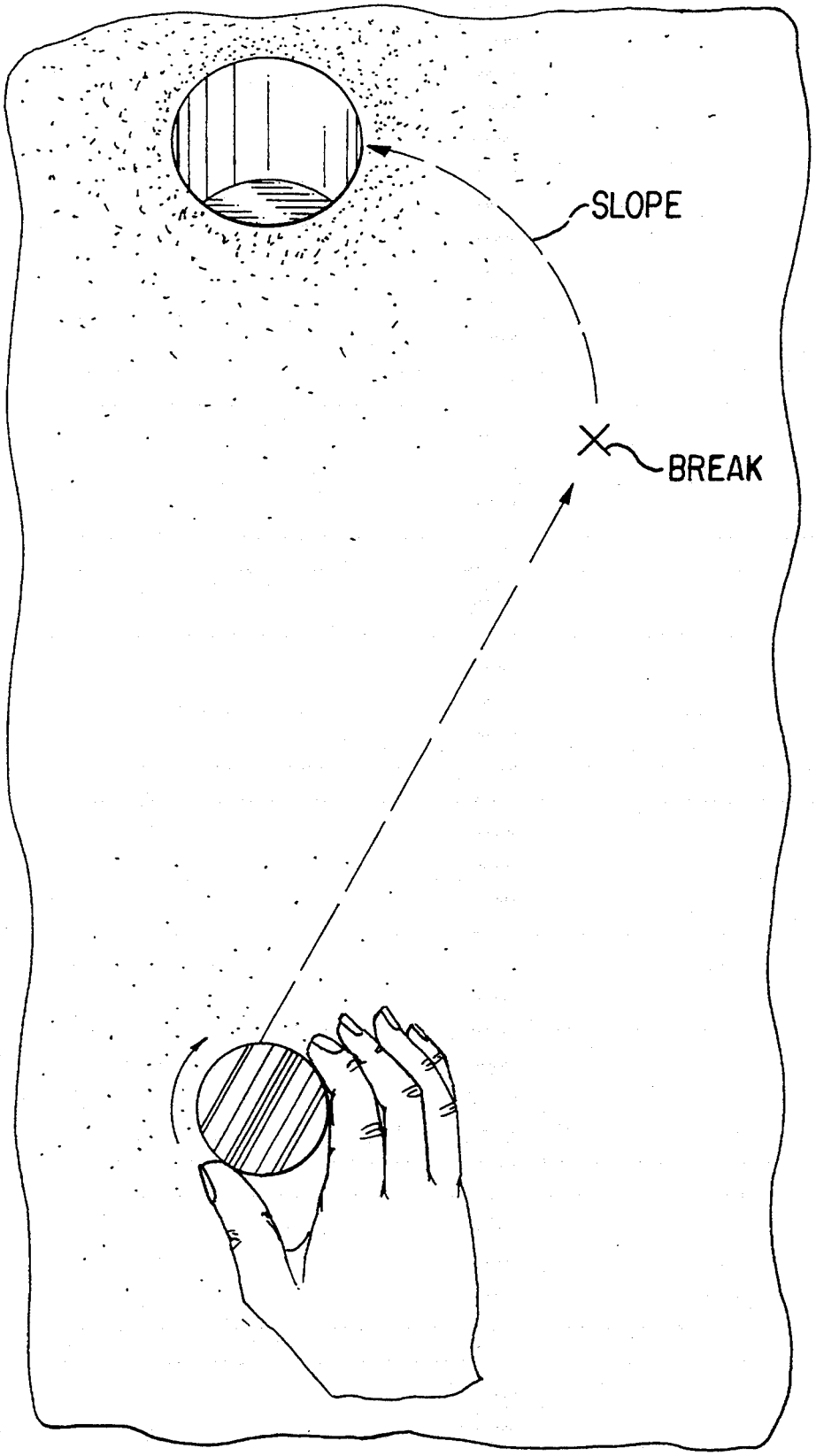
FIG. 4 is a perspective view of the putting-stroke aligner being rotated to be aligned with the chosen line of putt.

To practice the method of the invention, the golf ball marker 10 is used to mark the location of the ball 20 by placing the marker directly behind the ball so that line 18*a* points directly to the hole H as shown in FIG. 3. The ball is then lifted from the green. The golfer next aligns the directional indicia 18*a*, 18*b*, 18*c*, etc. to account for the grass grain, anticipated break, and the like, so that the various indicia 18, 19, etc. are aligned with the direction the golfer would like the putt to take as shown in FIG. 4. The indicia 18 and 19 are preferably in the form of ribs or rib pairs with spaces therebetween with the ribs 19*a* and 19*b* and ribs 18*b* and 18*c* being chords.

Since other than rotational movement of the marker is not allowed under the USGA Rules of Golf, the player must take care during rotation of the aligner. This can be done by pressing down slightly to hold the aligner in place and rotating it so that at least one of the various aligner lines 18, 19, etc. is pointing in the direction of the desired putt.

Figure 5:
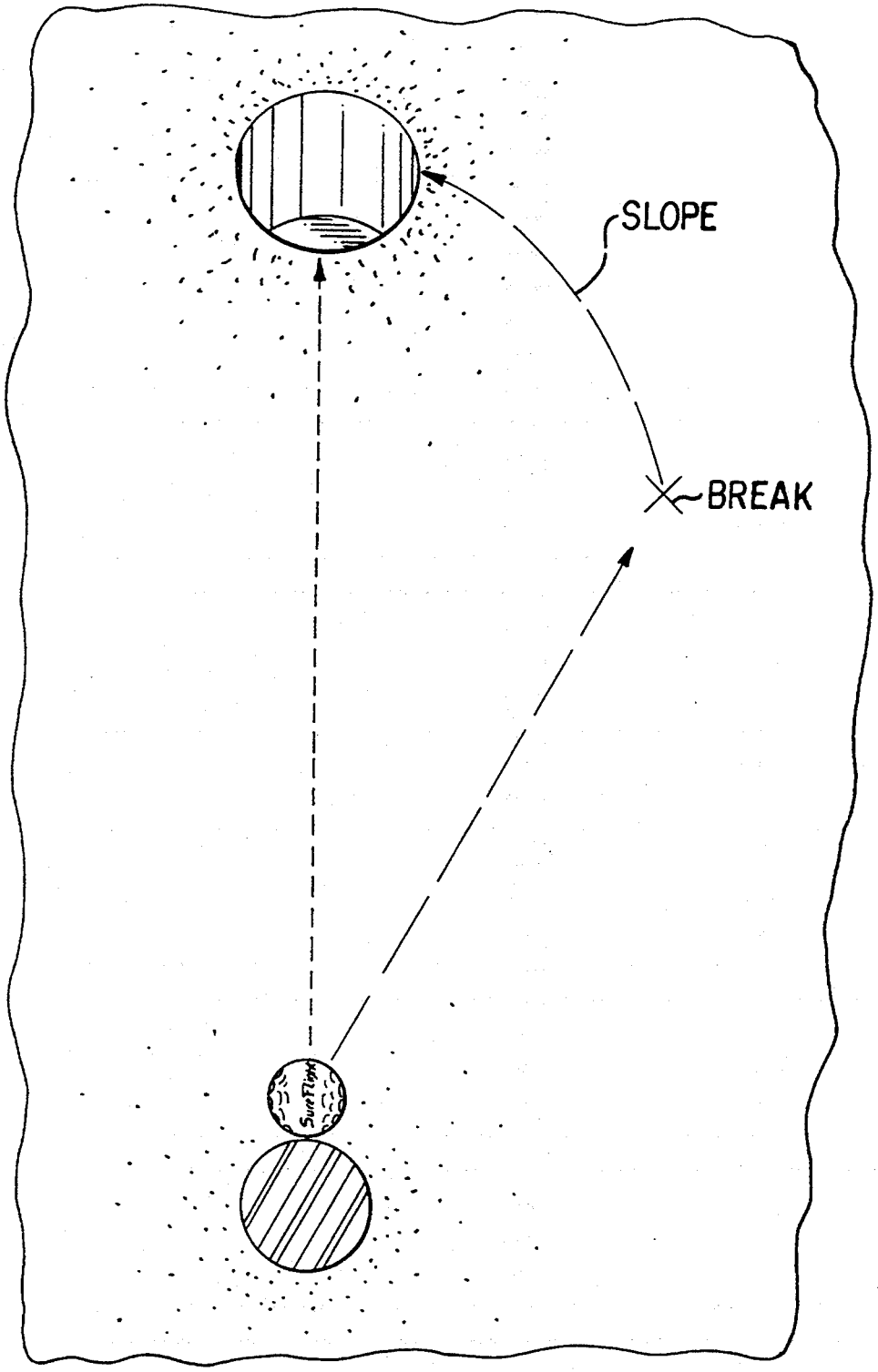
FIG. 5 is a perspective view of the ball replaced in the exact spot on the green as before the ball was lifted.
Figure 6:
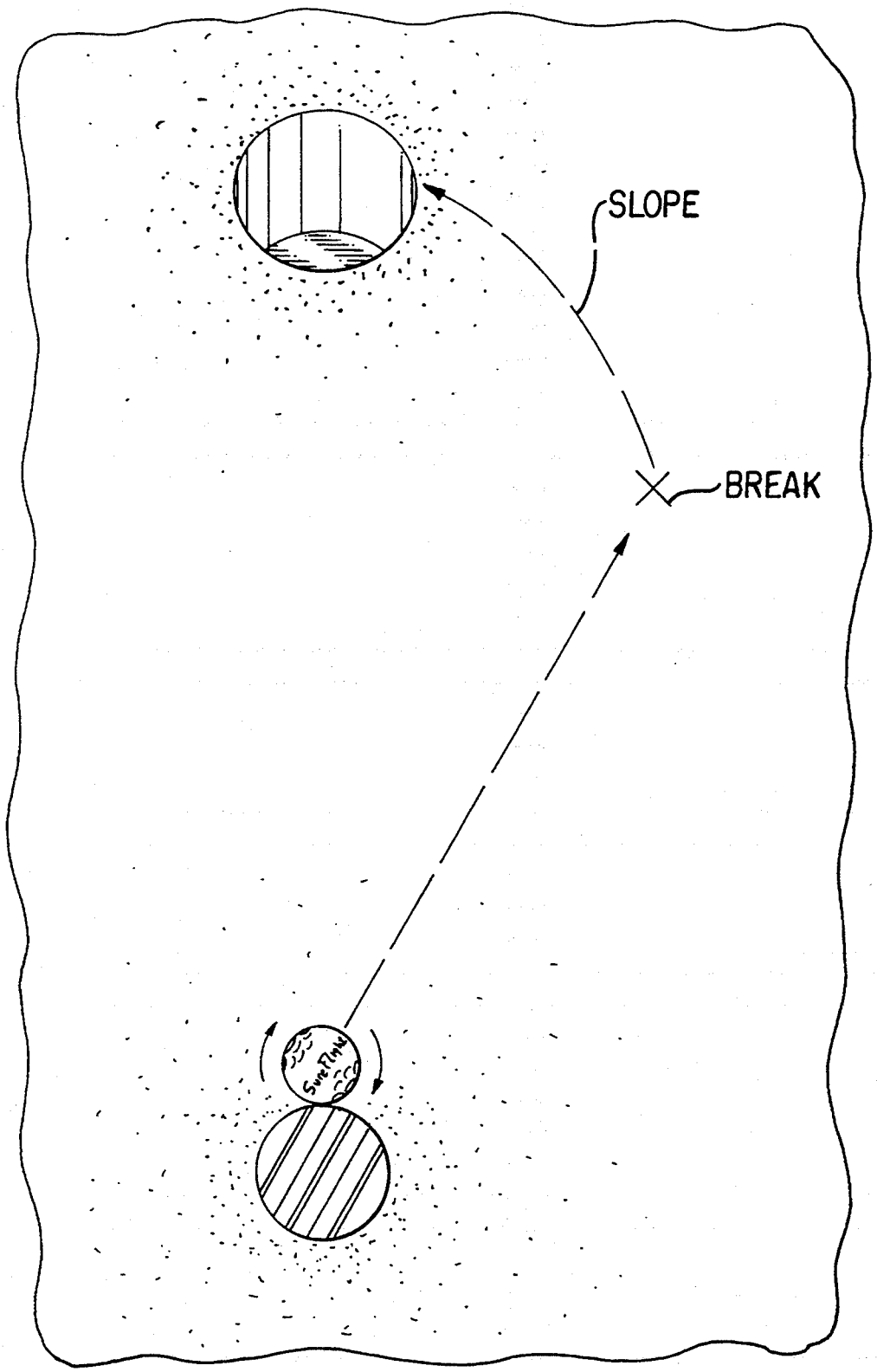
FIG. 6 is a perspective view of the lettering or other indicia on the ball aligned with the stroke-direction marks on the aligner in the direction of the line of putt.
Figure 7:
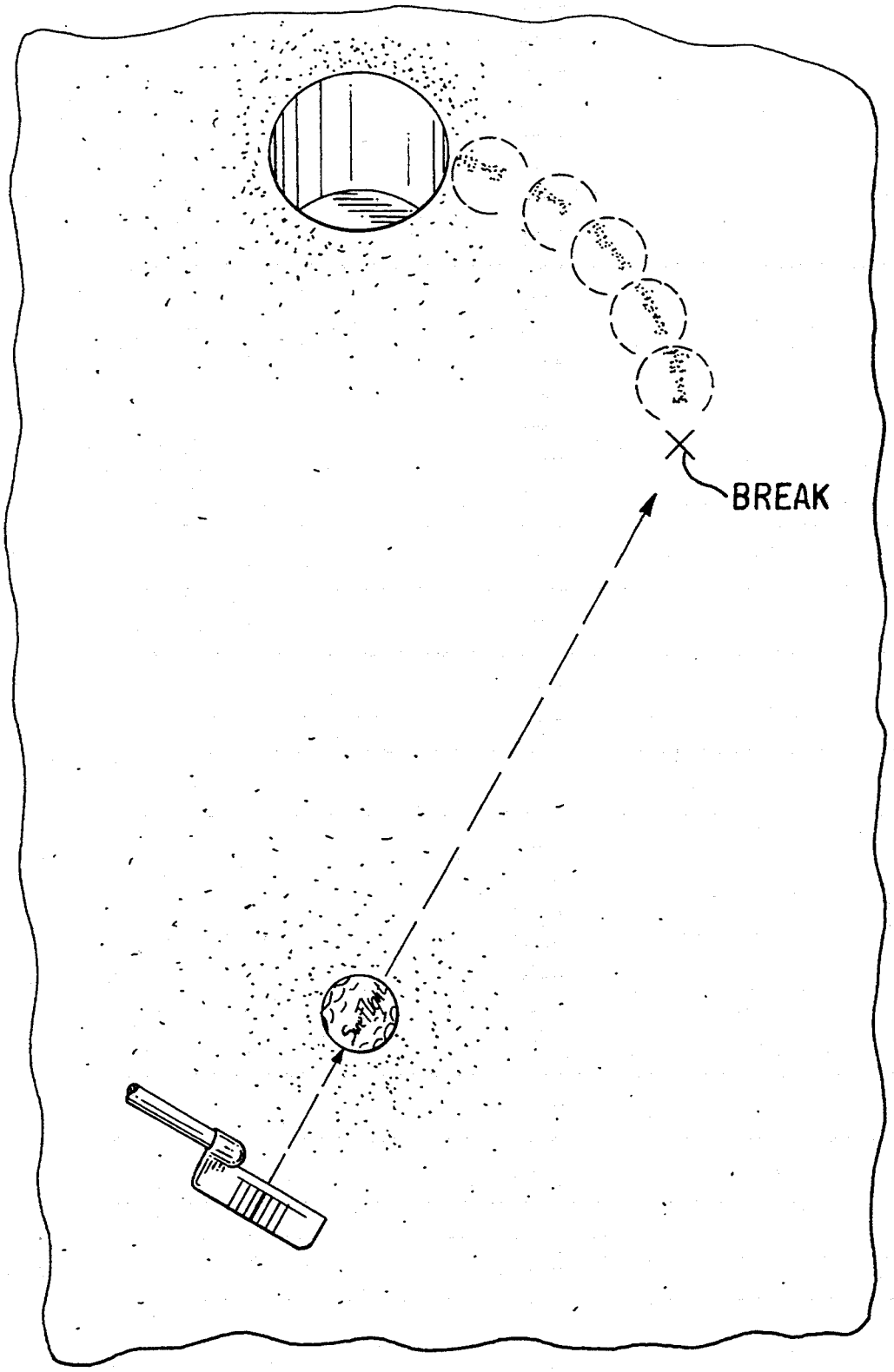
FIG. 7 is a perspective view of the putt stroke with the putter face perpendicular to the lettering or indicia on the ball surface.

When the golfer's turn arrives, the ball is replaced in line with the hole in front of the putting-stroke aligner as shown in FIG. 5 in the same spot on the green as before the ball was lifted. At that time, the marking 24 on the ball will be pointing at the center of the hole. The ball is then rotated (but not otherwise moved) so that the marking 24 is aligned with the aligning indicia 18, 19 etc. which may not be pointing at the center of the hole if there is a slope or the like on the surface of the green that will affect the putt (as shown in FIG. 6.) The aligner is then lifted leaving the ball as shown in FIG. 6. The player then strikes the ball so that the club face is perpendicular with the lettering on the ball (FIG. 7). This allows the player to focus primarily on the distance of the putt since the direction has already been determined as discussed above.

The above-described method of aligning a putt decreases the amount of time required to play and complete a round of golf because the golfers can be preparing for their putting strokes while other players are completing their putts. When it is a given player's turn to putt, it is simply necessary to replace the ball in alignment with the aligned direction of at least one of the indicia 18, 19, etc. on the marker as described above. This method permits the golfer to focus primarily on the distance of the putt, and should enable the golfer to achieve better putting results. It should also reduce the time for a foursome to play a round of golf by approximately 15-30 minutes.

The invention has been described in connection with the lifting of a golf ball as is required to permit another player to "play through." The invention can also be used, however, simply to align a golfer's putt without regard to whether it is otherwise necessary to mark the ball's location.

From the foregoing description, one skilled in the art can easily ascertain the essential characteristics of this invention and, without departing from the spirit and scope thereof, can make various changes and modifications of the invention to adapt it to various usages and conditions.

The embodiments of the invention in which an exclusive property as privilege is claimed are defined as follows:

1. A method of aligning a putting stroke for putting a golf ball into a golf green hole wherein the golf ball has dimples and a line of indicia separately discernible from the dimples, said method comprising the steps of:

aligning a ball position marker having a directional indicating marking on its surface so that said directional indicating marking is aligned with a line of chosen putt to define a desired putting path between said aligner and a hole in a golf green;

placing said golf ball at a position adjacent to said ball position marker so that the line of indicia on said golf ball has the same alignment as said directional indicating marking on said ball position marker; and, aligning a putter face perpendicular with said line of indica on said golf ball so that said putter face is perpendicular to said line of chosen putt.

2. The method of claim 1, including the step of putting said golf ball in the direction of said line of indicia.

3. The method of claim 2, wherein the golf ball position marker is comprised of metal, ceramic or plastic.

4. The method of claim 1, wherein said directional indicating marking is a groove, rib, or other indicia of direction.

5. The method of claim 1, wherein the ball position marker is a thin, flat body.

6. The method of claim 1, wherein the line of indicia on the golf ball is a line of writing identifying the golf ball by manufacturer or owner.

* * * * *